US007424767B2

(12) United States Patent
Giles et al.

(10) Patent No.: US 7,424,767 B2
(45) Date of Patent: Sep. 16, 2008

(54) STREET SWEEPER WITH LITTER HOSE

(75) Inventors: Brian David Giles, Elgin, IL (US); Peter J. McDonough, Delavan, WI (US)

(73) Assignee: Elgin Sweeper Co., Elgin, IL (US)

( * ) Notice: Subject to any disclaimer, the term of this patent is extended or adjusted under 35 U.S.C. 154(b) by 550 days.

(21) Appl. No.: 10/942,398

(22) Filed: Sep. 16, 2004

(65) Prior Publication Data

US 2006/0053583 A1 Mar. 16, 2006

(51) Int. Cl.
*E01H 1/08* (2006.01)

(52) U.S. Cl. ..... 15/331; 15/334; 15/347; 15/340.3

(58) Field of Classification Search ..... 15/331, 15/334, 347, 340.1, 340.2, 340.3, 340.4
See application file for complete search history.

(56) References Cited

U.S. PATENT DOCUMENTS

| | | | |
|---|---|---|---|
| 1,944,976 | A | 1/1934 | Hamilton |
| 2,878,508 | A | 3/1959 | Sedgwick et al. |
| 2,951,632 | A | 9/1960 | Hanson |
| 3,036,326 | A | 5/1962 | Hanson et al. |
| 3,052,908 | A | 9/1962 | Daneman |
| 3,193,867 | A | 7/1965 | Daneman et al. |
| 3,515,168 | A | 6/1970 | Tamny |
| 3,819,069 | A | 6/1974 | Bauman et al. |
| 4,460,186 | A | 7/1984 | Hildebrand et al. |
| 4,580,312 | A | 4/1986 | Van Raaij |
| 4,716,621 | A | 1/1988 | Zoni |
| 4,754,521 | A | 7/1988 | Zoni |
| 4,770,681 | A | 9/1988 | Hilger et al. |
| 4,796,327 | A | 1/1989 | Doyen |
| 4,862,548 | A | 9/1989 | Sergio |
| 4,868,948 | A | 9/1989 | Arnold |
| 4,884,313 | A | 12/1989 | Zoni |

(Continued)

FOREIGN PATENT DOCUMENTS

CA 2299654 * 8/2000

OTHER PUBLICATIONS

Brochure "Elgin Pelican Sweeper," Elgin Sweeper Co., May 2003.

(Continued)

*Primary Examiner*—David A Redding
(74) *Attorney, Agent, or Firm*—Merchant & Gould P.C.

(57) ABSTRACT

Provided is a street sweeper for collecting debris from a street surface. The street sweeper includes a chassis mounted on wheels, a rotating broom for removing debris from a street surface, and a hopper for collecting the removed debris. A passageway extends between the broom and the hopper to transfer the debris removed from the street surface. To remove debris from areas difficult to access with the rotating broom, the street sweeper also includes a litter hose connected to an air flow generating device that communicates with the hopper. The airflow generating device provides a suction force within the litter hose for removing debris and discharges that debris into the hopper. The airflow generating device and suction force work independently of the internal conditions of the hopper. In an embodiment, the airflow discharged into the hopper can exhaust through the passageway extending between the broom and the hopper.

34 Claims, 4 Drawing Sheets

U.S. PATENT DOCUMENTS

| | | | | |
|---|---|---|---|---|
| 4,993,107 | A | | 2/1991 | Zoni |
| 4,995,138 | A | | 2/1991 | Pullen |
| 5,050,265 | A | | 9/1991 | Stout et al. |
| 5,058,235 | A | | 10/1991 | Charky |
| 5,138,742 | A | | 8/1992 | Charky |
| 5,226,757 | A | | 7/1993 | Tarrant |
| 5,251,652 | A | | 10/1993 | Strauser et al. |
| 5,303,448 | A | * | 4/1994 | Hennessey et al. ..... 15/340.3 |
| 5,519,915 | A | | 5/1996 | Hollowell |
| 5,630,247 | A | | 5/1997 | Venia |
| 5,718,017 | A | | 2/1998 | Pavlick |
| 5,794,304 | A | | 8/1998 | Ritter |
| 5,852,847 | A | | 12/1998 | Weiss et al. |
| 5,943,733 | A | | 8/1999 | Tagliaferri |
| 5,983,447 | A | | 11/1999 | Boomgaarden |
| 6,003,195 | A | | 12/1999 | Whitney |
| 6,041,471 | A | | 3/2000 | Charky et al. |
| 6,092,261 | A | | 7/2000 | Boomgaarden |
| 6,142,290 | A | | 11/2000 | Tagliaferri |
| 6,223,387 | B1 | | 5/2001 | Anderson |
| 6,389,641 | B1 | | 5/2002 | Boomgaarden et al. |
| 6,412,203 | B1 | | 7/2002 | Libhart et al. |
| 6,428,590 | B1 | | 8/2002 | Lehman et al. |
| 6,519,805 | B2 | | 2/2003 | Firdaus et al. |
| 6,588,053 | B1 | | 7/2003 | Nowak |
| 2001/0029642 | A1 | | 10/2001 | Firdaus et al. |
| 2004/0003481 | A1 | | 1/2004 | Tarrant |
| 2004/0055470 | A1 | | 3/2004 | Strauser et al. |

OTHER PUBLICATIONS

Brochure "Elgin Whirlwind MV" Elgin Sweeper Co., Jun. 2002.
Brochure "Minuteman Litter Boss," Minuteman International Inc., Jul. 2001.
Alleged Patent Application entitled "Modular Street Sweeper", invented by Myrek Byczynski, received by Assignee via-email on Jul. 18, 2007.

* cited by examiner

STREET SWEEPER WITH LITTER HOSE

FIELD OF THE INVENTION

This invention pertains generally to municipal and utility vehicles and, more particularly, to mobile street sweepers adapted to remove debris from roadways and similar surfaces.

BACKGROUND OF THE INVENTION

Mobile street sweepers are commonly employed by municipalities to remove debris and dust from streets and other flat surfaces such as parking lots, runways and the like. Such street sweepers typically include a vehicle chassis and one or more rotating brooms mounted to the chassis for dislodging the debris from the surface to be swept. The debris is moved from the rotating brooms to a hopper for collection. Moving the debris may be accomplished by a powerful blower communicating with the hopper and drawing debris into the hopper or by a mechanical means such as a conveyor assembly. To empty the hopper when desired, the street sweeper can be adapted to lift and tilt the hopper with respect to the chassis.

To prevent debris collected in the hopper from escaping back to the environment, the hopper is formed as an enclosed structure that defines an internal volume. Except during emptying, access to the internal volume is limited to the deposit of debris from the rotating brooms. As such, the conditions of the internal volume are maintained in such a manner as to reduce or eliminate shifting air currents that can disrupt the collected debris. In some street sweeper systems, especially those utilizing mechanical means to convey debris to the hopper, a dust control system can also be provided that eliminates dust by exhausting air from the internal volume through a filter.

Since the rotating brooms are directed toward and proximate the street surface, debris removal by the street sweeper can only occur from the street surface. This hinders the removal of debris from difficult to reach areas, such as sidewalks, bus stop shelters, and around light posts. Additionally, in some instances, the size and nature of the debris may be such that collection via the rotating brooms could damage the street sweeper.

BRIEF SUMMARY OF THE INVENTION

The invention provides a mobile street sweeper adapted to remove litter and debris from difficult to reach areas. The street sweeper includes a wheeled chassis that can be driven over street surfaces by an operator. Mounted to the chassis are one or more rotating brooms for removing debris from the street surface while supported on the chassis is an enclosed hopper defining an internal volume for receiving the swept debris. To move debris between the brooms and the internal volume, a first passageway adapted to transfer debris is also included as part of the street sweeper.

To remove litter from hard to access areas, the street sweeper includes an air flow generating device and a flexible litter hose. The air flow generating device has an inlet and an outlet and is supported on the street sweeper in relation to the hopper such that the outlet communicates with the internal volume. The litter hose includes an opened first end and an opened second end. The first end can be adapted for manipulation by the operator of the street sweeper while the second end can communicate with the inlet of the air flow generating device.

The air flow generating device is capable of generating a suction force that removes debris from the first end of the flexible hose and discharges the debris into the internal volume. The generated suction force operates independently of, and therefore provides a suction force in the litter hose regardless of, the conditions in the internal volume. In various embodiments, the air flow discharged into the internal volume can be exhausted through the first passageway or, in those embodiments incorporating a dust control system, the air flow can be exhausted through the dust control system. The internal volume is arranged so that air flow discharged from the air flow generating device will not substantially disturb the collected debris.

An advantage of the invention is that it provides a street sweeper with a litter hose for removing debris from difficult to reach areas. Another advantage is that the invention allows for retrofitting existing street sweepers to include a litter hose. Another advantage is that the air flow generating device and the suction force it provides in the litter hose are independent from the dust control system for use in connection with the brooms. These and other advantages and features of the invention will be apparent from the foregoing drawings and detailed description.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims

DETAILED DESCRIPTION OF THE EMBODIMENTS

Figure 1:
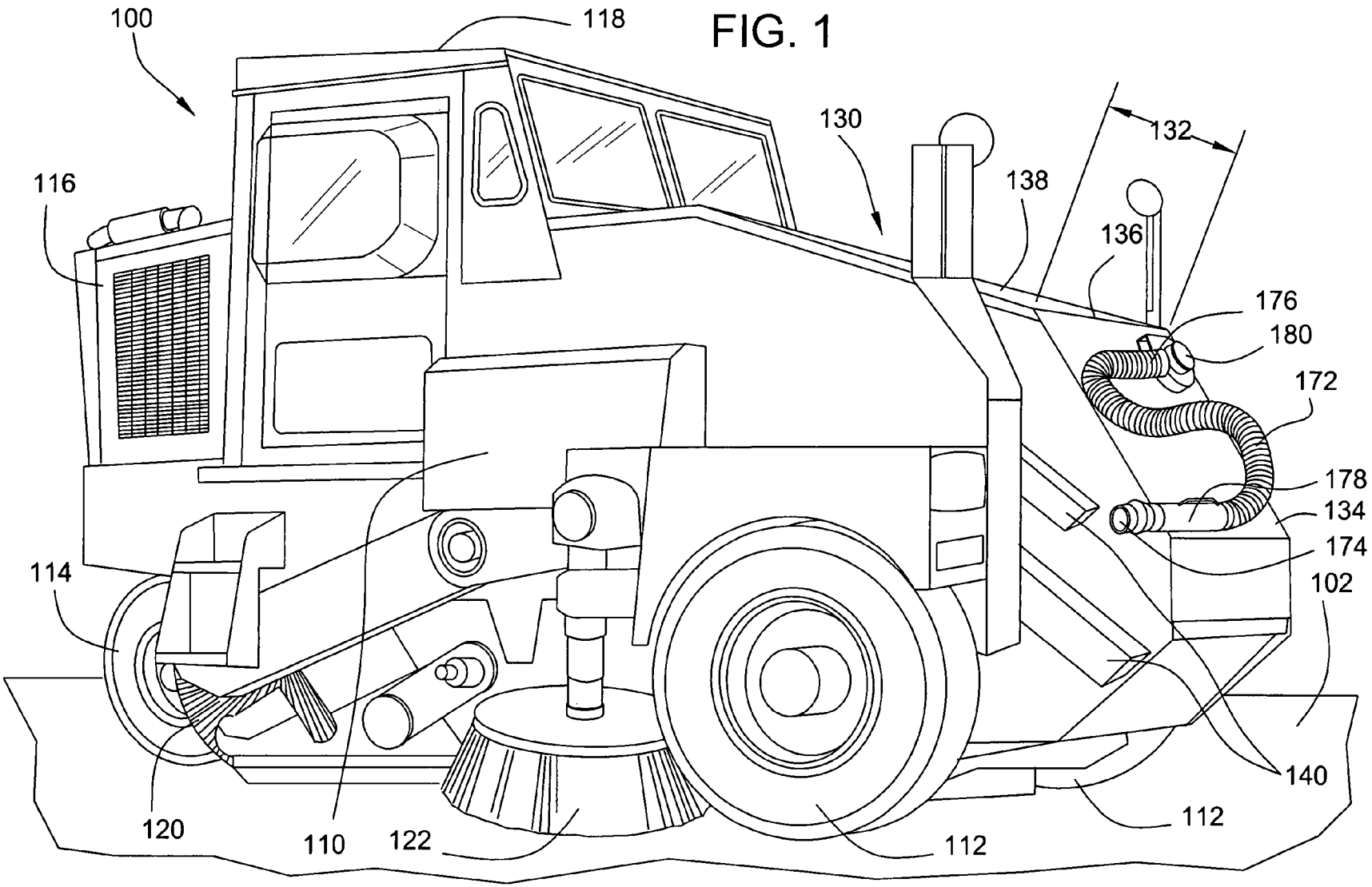
FIG. 1 is a perspective view of a three-wheeled street sweeper including rotating brooms and a litter hose.

Now referring to the drawings, wherein like reference numbers refer to like elements, there is illustrated an example of a self propelled street sweeper 100 for removing debris from street surfaces and the like. The street sweeper 100 includes a chassis 110 mounted on a plurality of wheels which support the street sweeper on a street surface 102 or the like. The particular street sweeper 100 illustrated in FIG. 1 is of the three-wheeled or tricycle arrangement having a pair of spaced-apart, driven, front wheels 112 and a steerable rear wheel 114. An advantage of the three-wheeled design is greatly improved maneuverability for the context in which street sweepers are typically employed. However, the three-wheeled arrangement is exemplary only and is not intended as a limitation of the invention.

For propelling and otherwise powering the street sweeper 100, an internal combustion engine 116 is attached to the chassis 110 generally above the rear wheel 114. The street sweeper 100 also includes an operator compartment 118 attached to the chassis 110 and located well-above the surface 102 for improved visibility. The operator compartment 118 can be an enclosed structure that protects the operator from environmental elements during operation. Located within the operator compartment 118 are controls for steering and otherwise operating the street sweeper 100.

To remove debris from a surface to be cleaned, the street sweeper 100 includes a cylindrical main broom 120 located generally underneath the operator compartment 118. The main broom 120 is rotatable with respect to the chassis 110 along an axis of rotation that runs parallel to and spaced above the surface 102. The street sweeper 100 also includes a pair of spaced-apart gutter brooms 122 located rearward of the front wheels 112 and spaced partially outward of the main broom 120. The gutter brooms 122 are journaled such that they also rotate with respect to the chassis 110 to direct debris from the gutter or curb toward the main broom 120. The main and gutter brooms 120, 122 can be made from a plurality of bristles and can be hydraulically powered by a hydraulic unit associated with the engine 116. Additionally, the brooms 120, 122 can be raised from a sweeping position wherein the brooms contact the surface 102 to avoid wear during transportation.

For receiving and holding debris removed from the street surface by the brooms 120, 122, the street sweeper 100 includes a hopper 130 supported on the chassis between the front wheels 112. The hopper 130 defines an internal volume and has a given width extending generally between the front wheels 112 as indicated by arrows 132. To empty the hopper 130 of debris, the hopper can be lifted and tilted with respect to the chassis. When tilted, a front plate 134 which is pivotally attached along a hinge line 136 to a top plate 138 pivots to dump the contents of the internal volume. A hydraulic lifting and tilting assembly 140, a portion of which is illustrated in FIG. 1, is provided for this purpose. Furthermore, the hopper 130 can be separable from the chassis to function as a stand-alone trash receptacle.

Figure 2:
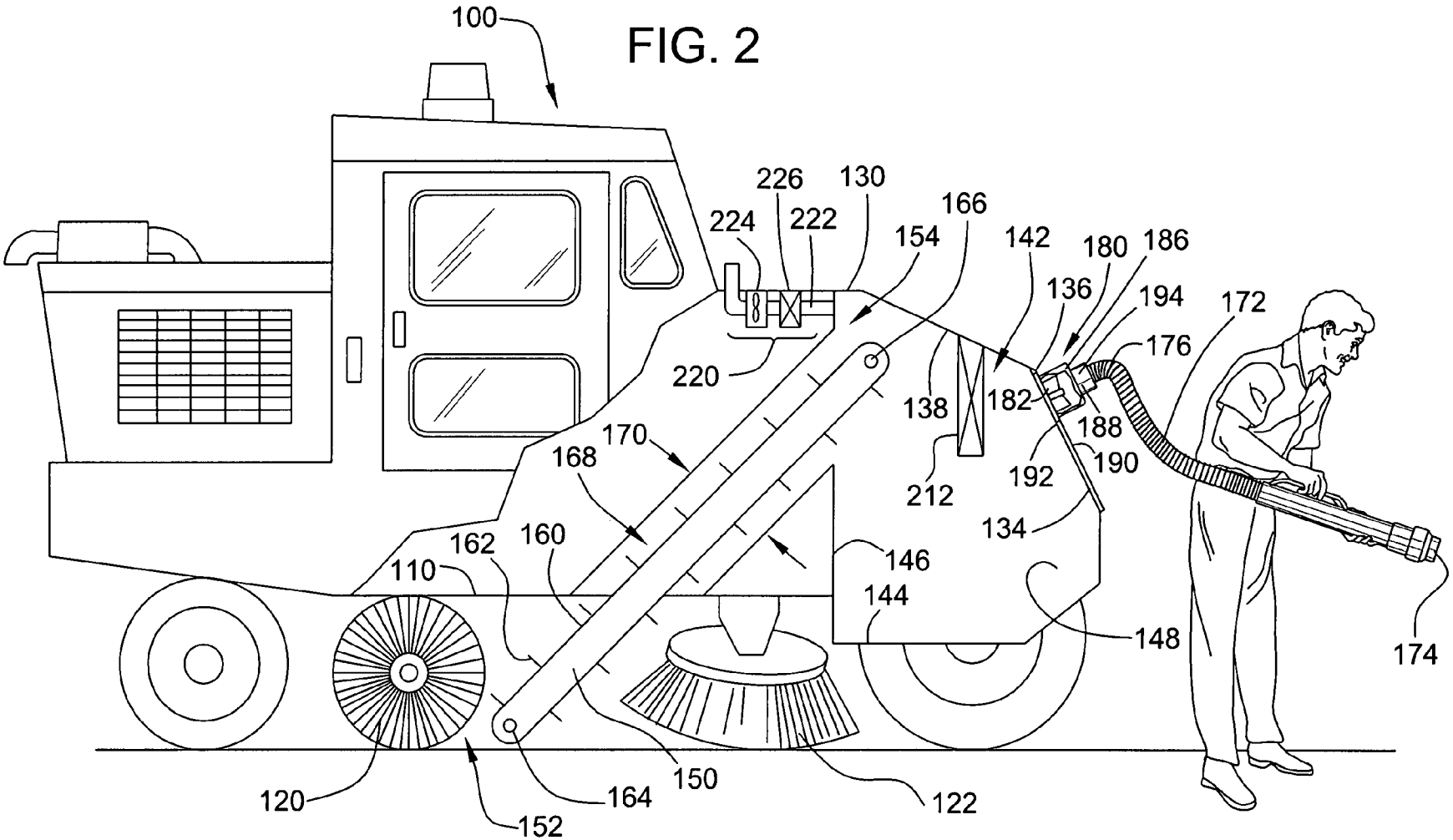
FIG. 2 is a side elevation cut-away view of the street sweeper illustrating the internal volume, the conveyor assembly, and the litter hose as being manipulated by an operator.

Referring to FIG. 2, to define the internal volume 142, the hopper 130 includes, in addition to the front and top plates 134, 138, a bottom plate 144 and a rear plate 146 as well as opposing side plates 148. The plates are joined together so that the internal volume 142 is substantially enclosed and that received debris is prevented from escaping. Specifically, adverse air currents that could otherwise disturb the collected debris are prevented from entering the internal volume 142. The plates are typically made of a metallic material and can be joined together by welding, brazing, or the like. Preferably, the internal volume as defined by the plates has a capacity of between about 3 cubic meters and about 5 cubic meters.

To transfer debris from the main broom 120 to the internal volume 142, a mechanical conveyor assembly 150 is mounted to the chassis 110. The conveyor assembly 150 extends between a first area 152 proximate the main broom 120 and a second area 154 that accesses the internal volume 142 through the rear plate of the hopper 130. The conveyor assembly 150 includes a plurality of projecting paddles 162 that extend from a continuous, flexible conveyor belt 160. The conveyor belt 160 may be made of an elastomeric material or from a plurality of panels pivotally linked together. The conveyor belt 160 extends around a first roller 164 positioned in the first area 152 and a second roller 166 positioned at the second area 154.

To accommodate the conveyor assembly 150, a conveyor passageway 168 is disposed through the street sweeper 100 between the first area 152 and the second area 154 thereby providing a clearance through which the conveyor assembly 150 extends. Preferably, the conveyor assembly 150 and conveyor passageway 168 are arranged so that the conveyor assembly extends at an angle through the street sweeper 100 with respect to the surface 102 on which the street sweeper is supported. Also preferably, to maximize its capacity, the conveyor assembly 150 and conveyor passageway 168 substantially correspond dimensionally to the width of the hopper 130 indicated by arrows 132 of FIG. 1. Furthermore referring to FIG. 2, the conveyor passageway 168 includes a height, as indicated by arrows 170, that provides clearance for paddles 162 extending from the conveyor belt 160.

In operation, the conveyor belt 160 rotates around the first and second rollers 164, 166 to remove debris from the first area proximate the main broom 120 and to convey the debris to the second area 154 accessing the internal volume 150 whereat the debris falls under the influence of gravity to the bottom floor 144 of the hopper 130. Due to the projecting paddles 162 and the angle of the conveyor assembly 150 through the street sweeper 100, debris is supported on top of the conveyor belt 160 during conveyance and will not fall back toward the first area 154. Additionally, the bottom plate 144 is located sufficiently below the second area 154 accessing the internal volume 150 so that previously received debris will not interfere with newly incoming debris.

Referring back to FIG. 1, there is also included on the street sweeper 110 for removing debris from areas difficult to access with the main and gutter brooms 120, 122 a flexible litter hose 172 that can be directly or indirectly manipulated by an operator. In the illustrated embodiment, the flexible litter hose 172 is a tubular structure extending between a first end 174 adapted with a handle 178 and a second end 176 connected to the front plate 134 of the hopper 130 and communicating with the internal volume. As will be appreciated, the litter hose 172 can be maneuvered into areas otherwise inaccessible to the brooms 120, 122 for removing debris. The debris is conveyed to the internal volume for collection together with the debris removed by the brooms.

Figure 3:
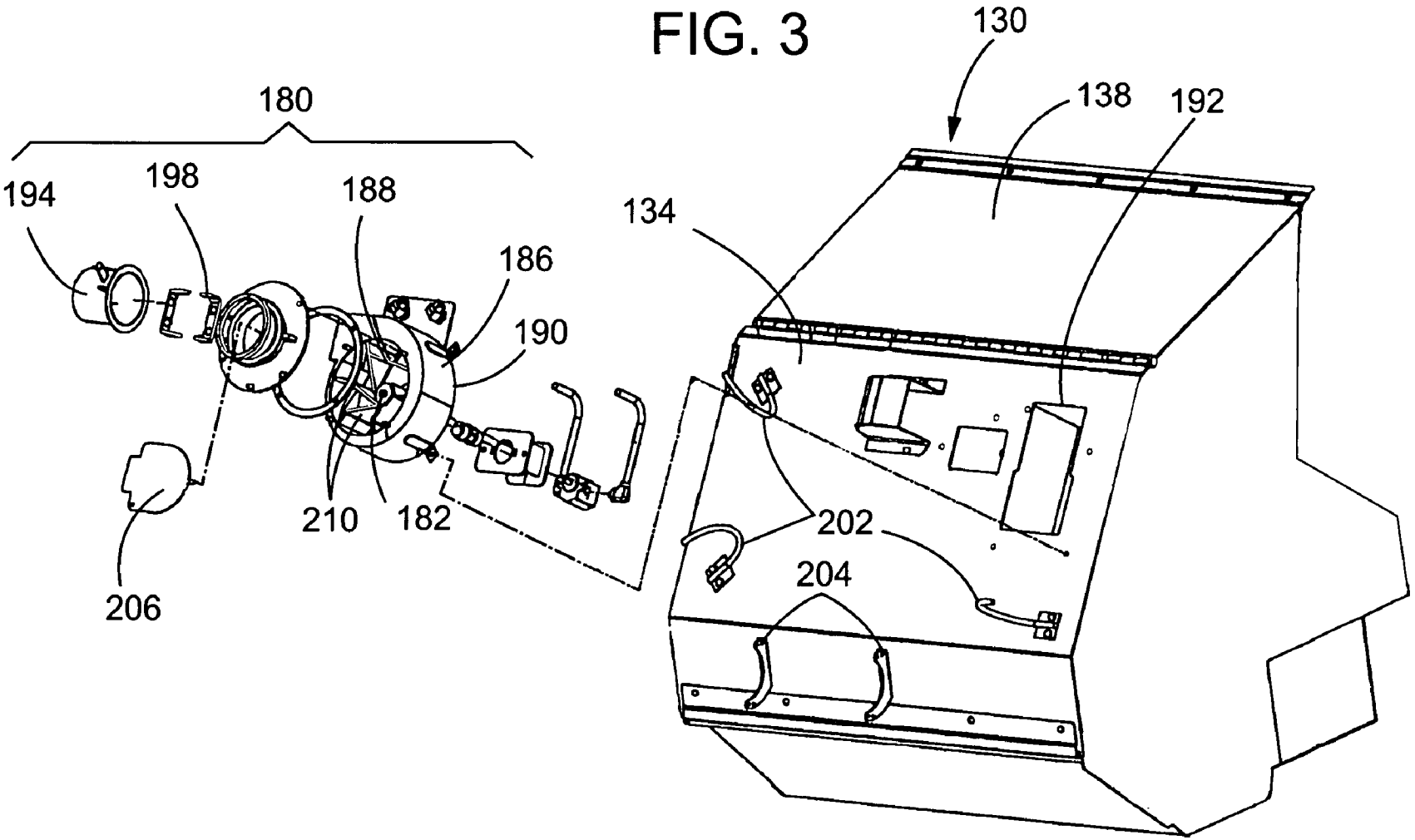
FIG. 3 is an exploded view of an air flow generating device as mounted to a front plate of the hopper.

As illustrated in FIGS. 1 and 2, to provide a suction force for directing debris through the litter hose 172, the street sweeper 100 includes an air flow generating device 180. Referring to FIG. 3, the air flow generating device 180 includes a rotating blade 182 enclosed in a drum-shaped housing 186. The housing 186 defines an inlet 188 for communicating with the litter hose and an outlet 190 for communicating with the internal volume. In the illustrated embodiment, the inlet 188 and outlet 190 are located on opposite sides of the drum-shaped housing 186 such that air flow is directed across the housing. The housing 186 can be mounted on the hopper 130 generally over an aperture 192 disposed through the front plate 134 proximate the top plate 138 which provides access to the internal volume 142. When the air flow generating device 180 is so mounted, the outlet 190 covers the aperture 192 and the inlet 188 is spaced-apart from the front plate 134.

Figure 4:
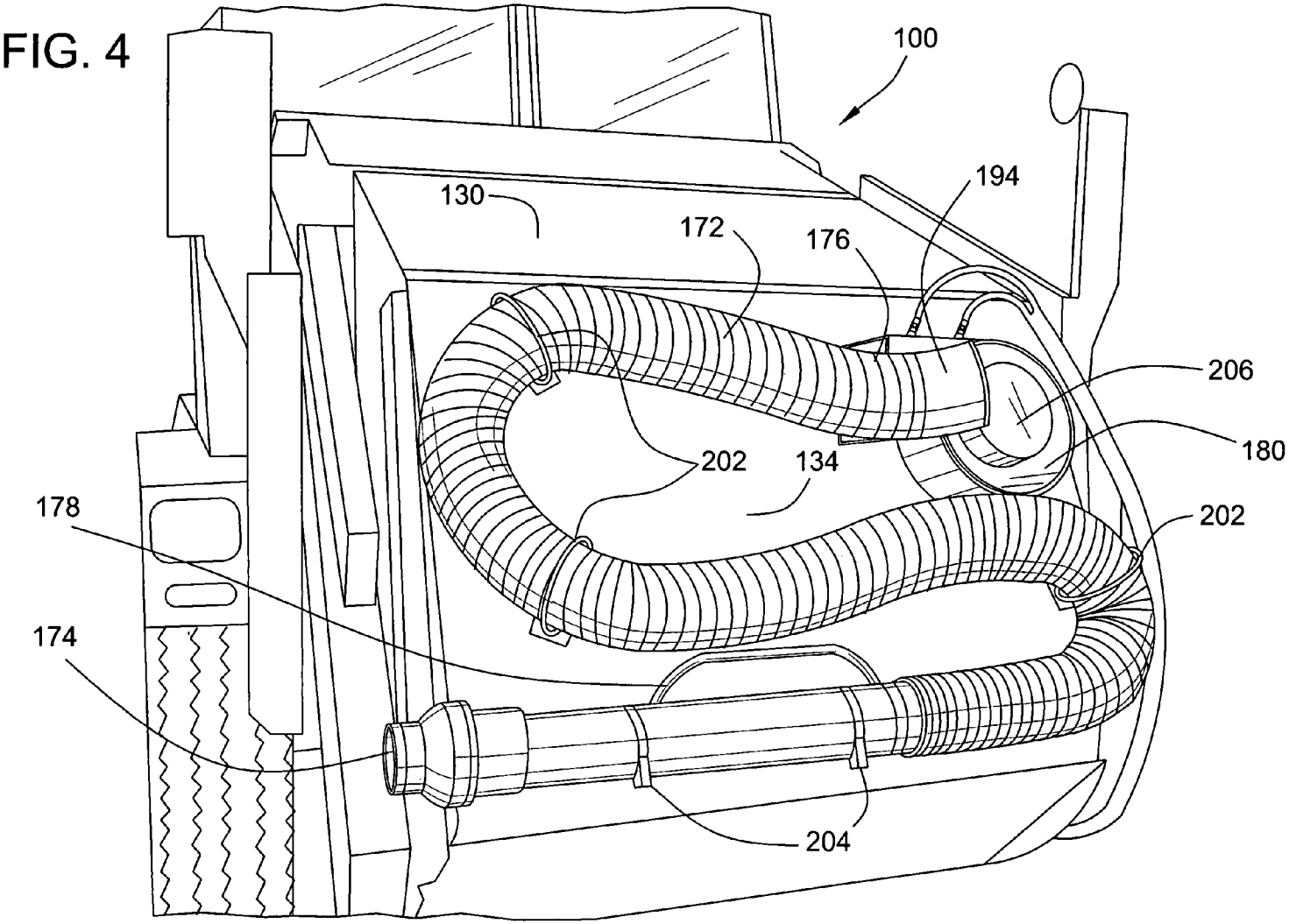
FIG. 4 is a front perspective view of the street sweeper illustrating the litter hose and the air flow generating device as mounted to the front plate of the hopper.

In an embodiment, the second end of the litter hose can connect to the inlet 188 via a cylindrical coupling 194 mounted on a coupling hinge 198. The coupling 194 pivots between a first position coaxially engaging the inlet 188 and a second position orthogonally off to the side of the inlet. Accordingly, as illustrated in FIG. 4, when the coupling 194 is pivoted to the second position, the litter hose 172 extends adjacently along the front plate 134. This facilitates storing the litter hose 172 during transit by winding the hose through hooks 202 extending from the front plate 134 of the hopper 130. Additionally, the hooks 202 hold the litter hose 172 to the front plate 134 when the hopper 130 is lifted and tilted to dump the collected debris. The first end 174 of the litter hose 172, including the attached handle 178, can be releasably held to the hopper 130 by a pair of brackets 204. Referring to FIGS. 3 and 4, as both a safety measure and to prevent debris from becoming lodged within the blade 182, a cover plate 206 is provided for enclosing the inlet 188.

In an embodiment, to maximize the density of debris collected in the hopper 130, the air flow generating device 180 can be configured to masticate incoming debris from the litter hose 172. Specifically, referring to FIG. 3, the rotating blade 182 includes multiple sharp blade elements 210 made from sufficiently hard material such as, for example, steel. The interaction of the blade elements 210 and inner surface of the housing 186 will chop incoming debris into finer portions that, when collected into the hopper 130, will reduce air suspended within the debris pile. Preferably, the air flow generating device 180 is even capable of the chipping small branches. In a further embodiment, when the coupling 194 is moved to the second position and the cover plate 206 is removed to expose the inlet 188 of the air flow generating device 180, the air flow generating device can be employed as a chipper wherein small branches can be feed directly into the inlet.

The controls for actuating the air flow generating device can be located in the operator compartment or on the housing itself. Preferably, the air flow generating device is normally inactive and is only actuated when utilizing the litter hose. In the embodiments wherein the coupling can be pivoted between first and second positions, safety interlocks can be provided to prevent actuation of the air flow generating device unless the coupling and second end of the litter hose engage the inlet. To drive the air flow generating device, hydraulic pressure can be supplied from the engine via hydraulic fittings on the housing.

Referring to FIG. 2, during operation, the air flow generating device 180 is actuated to direct air flow from the inlet 188 to the outlet 190 and thereby generate a suction force at the first end 174 of the litter hose 172. Debris from the first end 174 is directed through the air flow generating device 180 and discharged into the internal volume 142 through the aperture 192. Debris can be deflected out of the discharging air flow by an appropriately located baffle 212 extending from the top plate 138 and opposing the aperture 192 and outlet 190 of the air flow generating device 180. The deflected debris falls under the influence of gravity to the bottom plate 144 of the hopper 130. The baffle 212 may be in the form of a screen or otherwise perforated with holes to allow the air flow to pass across.

The air flow generating device 180 provides an independent source for generating the suction force within the litter hose 172. Accordingly, the litter hose 172 is employable on street sweepers that lack an innate suction or vacuum source, such a street sweepers employing mechanical conveyor assemblies, or that have an insufficient primary suction or vacuum source. Additionally, utilizing the air flow generating device 180 to provide suction allows for retrofitting existing street sweepers by disposing an aperture through the hopper and mounting an air flow generating device thereto.

The air flow generating device 180 also provides a suction force in the litter hose 172 regardless of the conditions in the internal volume 142 and, as such, the internal volume 142 may be pressurized, at ambient pressure, or at vacuum. Moreover, this configuration does not rely on the integrity of the internal volume to otherwise provide the suction force in the litter hose. Instead, this configuration provides a suction force regardless of any leaks or breaches in the internal volume. If a single airflow generating device was positioned to draw air from the internal volume in the first instance, the suction force provided in the litter hose would be diminished because of air flowing from the first passageway provided for moving debris from the brooms. While the invention could be arranged to operate in such configurations, the preferred implementation does not rely on such air flow systems or the integrity of the internal volume. To maintain the integrity of the internal volume 142 when the litter hose 172 is not in use, the cover plate can be placed over the inlet 188 thereby effectively sealing the aperture 192.

To prevent the air flow being discharged into the internal volume 142 from disturbing the collected debris or otherwise pressurizing the hopper 130, the air flow is exhausted into the conveyor passageway 168 via the second area 154 accessing the internal volume. The aperture 192 through which the air flow discharges from the air flow generating device 180 is preferably located directly opposite second area 154 so that air flow is directed out of the internal volume 142 without substantially disturbing the collected debris. Opposing the aperture 192 and second area 154 also reduces the risk that discharging air flow will generate secondary air currents within the internal volume 142 that could disturb the collected debris. The discharged air flows along the conveyor assembly 150 within the conveyor passageway 168 and exhausts out the first area 152 proximate the main broom 120.

Preferably, the conveyor passageway 168 is dimensioned to prevent the air discharged by the air flow generating device 180 from backing up within the internal volume 142. Specifically, the conveyor passageway 168 has a first cross-sectional area transverse to motion of the conveyor assembly 150. The first cross-sectional area is determined by height of the conveyor passageway 168 as indicated by arrows 170 and the width of the conveyor passageway across the chassis 110. A second cross-sectional area can be measured by the inner diameter of the litter hose 172 transverse to the direction of the suction force. The first cross-sectional area of the conveyor passageway 168 should be substantially larger than a second cross-sectional area of the litter hose 172. Accordingly, for a given volumetric capacity of the air flow generating device 180, the velocity and pressure of air flow exhausting through the conveyor passageway 168 will be less than the velocity and pressure of the air flow providing the suction force at the first end 174 of the litter hose 172. An advantage of reducing the velocity and pressure of the exhausting air flow is that debris on the conveyor assembly 150 will not be blown back down toward the first area 152 proximate the main broom 120. By way of example, a ratio of the first cross-sectional area compared to the second cross-sectional area is preferably about 20 to 1.

In an embodiment of the street sweeper 100, a dust control unit 220 can be incorporated to remove dust from the internal volume 142. The dust control unit 220 is mounted within the chassis 110 and communicates with the internal volume 142 through a conduit 222. The dust control unit 220 includes a suction source 224 such as a fan that applies a second suction force to the internal volume 142 and exhausts to the surrounding environment. When in operation, as will be appreciated, at least a portion of the air discharging from the air flow generating device 180 can exhaust through the dust control unit 220. The second suction force should be insufficient to disturb or draw in debris collected at the bottom of the hopper. To remove dust from the air drawn by the second suction force, a filter 226 is placed along the conduit 222 between the internal volume 142 and the suction source 224. In an alternative design, the filter 226 can be placed downstream of the suction source 224. As will be appreciated, the filter 226 must occasionally be cleaned or replaced.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A street sweeper for cleaning surfaces of streets and the like comprising:

a chassis mounted on at least two wheels to provide support to the chassis;

at least one sweeping broom contactable with a surface to be cleaned;

a hopper supported on the chassis, the hopper defining an internal volume for receiving debris from the surface to be cleaned, the hopper adapted to be emptied of the received debris by instigation of an operator of the street sweeper;

a conveyor assembly mounted to the chassis, the conveyor assembly extending generally between a first area proximate the sweeping broom and a second area accessing the internal volume, the conveyor assembly adapted for conveying debris from the first area to the second area;

an air flow generating device having an inlet and an outlet supported in relation to the hopper, the outlet communicating with the internal volume;

a flexible litter hose having an opened first end and an opened second end, the second end communicating with the inlet of the air flow generating device, the first end adapted to be manipulated by the operator of the street sweeper;

the air flow generating device, the hopper, and the litter hose being positioned and arranged such that air entering the litter hose flows through the air generating device and then into the hopper; and wherein the air flow generating device develops a suction force for removing debris at the first end of the litter hose by directing air flow from the inlet to the outlet, the suction force being independent of conditions in the internal volume.

2. The street sweeper of claim 1, further comprising a conveyor passageway in which the conveyor assembly extends.

3. The street sweeper of claim 2, wherein air flow from the outlet of the air flow generating device exhausts through the conveyor passageway.

4. The street sweeper of claim 3, wherein the first end of the litter hose has a first cross-sectional area transverse to the direction of the suction force, and the conveyor passageway has a second cross-sectional area transverse with respect to the motion of the conveyor assembly, wherein the first cross-sectional area is about 5% or less of the second cross-sectional area.

5. The street sweeper of claim 1, wherein the air flow generating device is a rotating blade generally enclosed in a housing.

6. The street sweeper of claim 5, wherein the rotating blade masticates debris removed by the suction force.

7. The street sweeper of claim 1, further comprising a dust control unit communicating with the internal volume via a filter, the dust control unit applying a second suction force to the internal volume through the filter.

8. The street sweeper of claim 1, further comprising a baffle in the internal volume opposing the outlet of the air flow generating device, the baffle deflecting debris out of the air flow from the outlet.

9. The street sweeper of claim 1, wherein the air flow generating device is selectively operable by the operator of the street sweeper.

10. The street sweeper of claim 1, wherein the internal volume has a capacity of between about 3 cubic meters and about 5 cubic meters.

11. The street sweeper of claim 1, wherein the sweeping broom assembly rotates with respect to the chassis.

12. A street sweeper for cleaning the surfaces of street and the like comprising:

a chassis supported on two or more wheels;

at least one sweeping broom contactable with a surface to be cleaned;

a hopper supported on the chassis, the hopper defining an internal volume for receiving debris removed from the surface to be cleaned, the hopper adapted to be emptied upon instigation by an operator of the street sweeper;

a conveyor assembly extending between a first area proximate the sweeping broom and a second area accessing the internal volume, the conveyor assembly adapted for conveying debris from the first area to the second area;

an air flow generating device having an inlet and an outlet, the outlet communicating with the internal volume; and a flexible litter hose having an opened first end and an opened second end, the second end communicating with the inlet of the air flow generating device, the first end adapted to be manipulated by the operator of the street sweeper;

wherein, the air flow generating device directs air flow from the first end of the litter hose through the inlet and the outlet and into the internal hopper, at least a portion of the air flow exhausting from the internal hopper through the second area where the conveyor assembly accesses the internal hopper.

13. The street sweeper of claim 12, further comprising a conveyor passageway in which the conveyor assembly extends.

14. The street sweeper of claim 13, wherein air flow exhausting from the internal hopper is directed through the conveyor passageway.

15. The street sweeper of claim 14, wherein the first end of the litter hose has a first cross-sectional area transverse to the direction of air flow, and the conveyor passageway has a second cross-sectional area transverse with respect to the motion of the conveyor assembly, wherein the first cross-sectional area is about 5% or less of the second cross-sectional area.

16. The street sweeper of claim 12, further comprising a dust control unit communicating with the internal volume via a filter, the dust control unit applying a suction force to the internal volume through the filter.

17. The street sweeper of claim 12, further comprising a baffle in the internal volume opposing the outlet of the air flow generating device, the baffle deflecting debris out of the air flow from the outlet.

18. A method of removing debris from the surfaces of streets or the like, the method comprising:

providing an internal volume supported on a wheeled chassis;

transferring debris from a surface to be cleaned along a first passageway accessing the internal volume;

directing air flow proximate a second surface to be cleaned through a first end of a litter hose to a second end of the litter hose by use of an air flow generating device such that air entering the litter hose flows through the air flow generating device and then into the internal volume, the second end communicating with the internal volume; and exhausting at least a portion of the air flow from the internal volume.

19. The method of claim 18, wherein the step of exhausting at least a portion of the air flow occurs though the first passageway.

20. The method of claim 18, wherein the step of transferring litter along the first passageway includes operating a conveyor assembly within the first passageway.

21. The method of claim 18, wherein the step of directing air flow includes developing a suction force at the first end of the litter hose, the suction force being independent of conditions in the internal volume.

22. A litter collecting device comprising:

a wheeled chassis;

a sweeping broom contactable with a surface to be cleaned, the sweeping broom rotating with respect to the wheeled chassis; an internal volume supported on the chassis for receiving debris removed from the surface to be cleaned;

a first passageway extending between an first area proximate the sweeping broom and a second area accessing the internal volume, the first passageway adapted to transfer debris from the first area to the second area;

a litter hose extending between a first end and a second end;

and an airflow generating device having an inlet and an outlet, the inlet communicating with the second end of the litter hose and the outlet communicating with the internal volume; the airflow generating device, the internal volume, and the litter hose being positioned and arranged such that air entering the litter hose flows through the air generating device and then into the internal volume; and wherein the airflow generating device generates a suction force at the first end of the litter hose by directing air flow from the inlet to the outlet, the suction force being independent of conditions in the internal volume.

23. A street sweeper for cleaning surfaces of streets and the like comprising:

a chassis mounted on at least two wheels to provide support to the chassis;

at least one sweeping broom contactable with a surface to be cleaned;

a hopper supported on the chassis, the hopper defining an internal volume for receiving debris from the surface to be cleaned, the hopper adapted to be emptied of the received debris by instigation of an operator of the street sweeper;

a conveyor assembly mounted to the chassis, the conveyor assembly extending generally between a first area proximate the sweeping broom and a second area accessing the internal volume, the conveyor assembly adapted for conveying debris from the first area to the second area;

a conveyor passageway in which the conveyor assembly extends;

an air flow generating device having an inlet and an outlet supported in relation to the hopper, the outlet communicating with the internal volume, the air flow from the outlet of the air flow generating device exhausting through the conveyor passageway;

a flexible litter hose having an opened first end and an opened second end, the second end communicating with the inlet of the air flow generating device, the first end adapted to be manipulated by the operator of the street sweeper;

wherein the air flow generating device develops a suction force for removing debris at the first end of the litter hose by directing air flow from the inlet to the outlet, the suction force being independent of conditions in the internal volume.

24. The street sweeper of claim 23, wherein the air flow generating device is a rotating blade generally enclosed in a housing.

25. The street sweeper of claim 23, further comprising a dust control unit communicating with the internal volume via a filter, the dust control unit applying a second suction force to the internal volume through the filter.

26. A street sweeper for cleaning surfaces of streets and the like comprising:

a chassis mounted on at least two wheels to provide support to the chassis;

at least one sweeping broom contactable with a surface to be cleaned;

a hopper supported on the chassis, the hopper defining an internal volume for receiving debris from the surface to be cleaned, the hopper adapted to be emptied of the received debris by instigation of an operator of the street sweeper;

a conveyor assembly mounted to the chassis, the conveyor assembly extending generally between a first area proximate the sweeping broom and a second area accessing the internal volume, the conveyor assembly adapted for conveying debris from the first area to the second area;

an air flow generating device having an inlet and an outlet supported in relation to the hopper, the outlet communicating with the internal volume; the air flow generating device being a rotating blade generally enclosed in a housing; the rotating blade masticating debris removed by the suction force;

a flexible litter hose having a opened first end and a opened second end, the second end communicating with the inlet of the air flow generating device, the first end adapted to be manipulated by the operator of the street sweeper;

wherein the air flow generating device develops a suction force for removing debris at the first end of the litter hose by directing air flow from the inlet to the outlet, the suction force being independent of conditions in the internal volume.

27. The street sweeper of claim 26, further comprising a baffle in the internal volume opposing the outlet of the air flow generating device, the baffle deflecting debris out of the air flow from the outlet.

28. The street sweeper of claim 26, wherein the air flow generating device is selectively operable by the operator of the street sweeper.

29. The street sweeper of claim 26, further comprising a conveyor passageway in which the conveyor assembly extends.

30. A street sweeper for cleaning surfaces of streets and the like comprising:

a chassis mounted on at least two wheels to provide support to the chassis;

at least one sweeping broom contactable with a surface to be cleaned;

a hopper supported on the chassis, the hopper defining an internal volume for receiving debris from the surface to be cleaned, the hopper adapted to be emptied of the received debris by instigation of an operator of the street sweeper;

a conveyor assembly mounted to the chassis, the conveyor assembly extending generally between a first area proximate the sweeping broom and a second area accessing the internal volume, the conveyor assembly adapted for conveying debris from the first area to the second area;

an air flow generating device having an inlet and an outlet supported in relation to the hopper, the outlet communicating with the internal volume;

a flexible litter hose having an opened first end and an opened second end, the second end communicating with the inlet of the air flow generating device, the first end adapted to be manipulated by the operator of the street sweeper;

a dust control unit communicating with the internal volume via a filter, the dust control unit applying a second suction force to the internal volume through the filter;

wherein the air flow generating device develops a suction force for removing debris at the first end of the litter hose by directing air flow from the inlet to the outlet, the suction force being independent of conditions in the internal volume.

31. The street sweeper of claim 30, wherein the internal volume has a capacity of between about 3 cubic meters and about 5 cubic meters.

32. The street sweeper of claim 30, wherein the air flow generating device is a rotating blade generally enclosed in a housing.

33. A method of removing debris from the surfaces of streets or the like, the method comprising:

providing an internal volume supported on a wheeled chassis;

transferring debris from a surface to be cleaned along a first passageway accessing the internal volume;

directing air flow proximate a second surface to be cleaned through a first end of a litter hose to a second end of the litter hose, the second end communicating with the internal volume; and exhausting at least a portion of the air flow from the internal volume through the first passageway.

34. The method of claim 33, wherein the step of directing air flow includes developing a suction force at the first end of the litter hose, the suction force being independent of conditions in the internal volume.

* * * * *

UNITED STATES PATENT AND TRADEMARK OFFICE

CERTIFICATE OF CORRECTION

PATENT NO. : 7,424,767 B2
APPLICATION NO. : 10/942398
DATED : September 16, 2008
INVENTOR(S) : Giles et al.

It is certified that error appears in the above-identified patent and that said Letters Patent is hereby corrected as shown below:

Col. 9, line 55, claim 22: "between an first" should read --between a first--

Signed and Sealed this

Seventeenth Day of February, 2009

John Doll

JOHN DOLL
*Acting Director of the United States Patent and Trademark Office*